US006361280B1

(12) United States Patent
Furnas

(10) Patent No.: US 6,361,280 B1
(45) Date of Patent: Mar. 26, 2002

(54) SYSTEM AND METHOD FOR LOCKING PARTS TO A ROTATABLE SHAFT

(75) Inventor: Michael W. Furnas, Dewey, OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/476,832

(22) Filed: Jan. 3, 2000

(51) Int. Cl.[7] ..... F04D 29/18
(52) U.S. Cl. ..... 416/244 R; 415/126
(58) Field of Search ..... 415/198, 199.1, 415/126; 416/244 R, 244 A

(56) References Cited

U.S. PATENT DOCUMENTS 3,367,627 A * 2/1968 Benz ..... 415/126
3,618,994 A * 11/1971 Gepfert ..... 416/204 R
3,715,176 A * 2/1973 Kerklo ..... 415/199.1
3,771,927 A * 11/1973 Schiller ..... 416/244 A
3,825,366 A * 7/1974 Herrick ..... 415/199.1
6,106,224 A * 8/2000 Sheth et al. ..... 415/199.1

* cited by examiner

*Primary Examiner*—John Kwon
(74) *Attorney, Agent, or Firm*—Fletcher, Yoder & Van Someren

(57) ABSTRACT

An improved system for mounting components to a rotatable shaft. The improved system may include a pump having impellers keyed to a rotatable shaft. Diffusers cooperate with the impellers to conduct pumped fluid upward from the impeller. The improved system for mounting includes a plurality of stop rings and an expansion assembly. A stop ring is secured to the shaft at each end of the rotatable component. An expansion assembly is disposed between a first stop ring and the rotatable component. The expansion assembly is axially expanded to force the rotatable component against a second stop ring.

17 Claims, 6 Drawing Sheets

SYSTEM AND METHOD FOR LOCKING PARTS TO A ROTATABLE SHAFT

FIELD OF THE INVENTION

The present invention relates generally to rotating equipment and, particularly, to a pumping system in which a pump impeller is mounted to a rotatable shaft.

BACKGROUND OF THE INVENTION

Submergible pumps are used in a wide variety of environments. One exemplary environment is a subsurface oil reservoir. A submergible pumping system, having a submergible, centrifugal pump, is inserted into the subsurface oil via a wellbore to permit the pumping of oil to a point at or above the surface. Production fluids enter a wellbore via perforations formed in a well casing adjacent a production formation. Fluids contained in the formation collect in the wellbore and may be raised by the submergible pumping system to a collection point above the earth's surface.

In an exemplary submergible pumping system, the system includes several components, such as a submergible electric motor that supplies energy to a submergible pump. The system may also include a variety of other components, such as motor protectors, pressure and temperature sensing instruments, gas separators and a variety of other components. A connector is used to connect the submergible pumping system to a deployment system. For example, a submergible pumping system may be deployed by production tubing through which production fluids, such as petroleum, are pumped to the surface of the earth. Other deployment systems include cable and coiled tubing.

Power is supplied to the submergible electric motor via a power cable that runs along the deployment system. For example, the power cable may be banded to the outside of the production tubing and directed to the submerged motor.

A typical submergible pump includes several impellers mounted to a shaft for rotation within an outer housing of the pump. A diffuser cooperates with each impeller to guide the fluid in the direction of flow from one impeller to the next sequential impeller. Unlike the impellers, the diffusers are fixed to the outer housing.

The rotatable components on the shaft, such as the impeller, are aligned to cooperate with the fixed components on the outer housing, such as the diffuser. Typically, the clearances between the rotatable components on the shaft and the fixed components on the outer housing are very small. Equipment damage occurs when the rotatable components mounted to the shaft have axial movement independent of the shaft. This is referred to as "false end play." For example, if an impeller has sufficient axial movement on the shaft, the impeller may come into contact with a diffuser.

Prior methods of preventing "false end play" have utilized large and heavy devices with which to lock the parts to the shaft. The masses of these devices and the speeds involved have contributed to accelerated radial wear, leading to premature equipment failure.

It would be advantageous to have a system whereby rotating components could be secured to a rotatable shaft so as to prevent axial movement of the rotating components relative to the shaft and without the problems associated with large, heavy locking devices.

SUMMARY OF THE INVENTION

The present invention features a system for securing rotatable components to a rotatable shaft. The system includes a rotatable shaft and first and second stops. The stops form a barrier to axial motion along the rotatable shaft. The system further includes a rotatable component that can be placed on the rotatable shaft between the two stop rings and an expansion assembly. The expansion assembly has an adjustable axial length and is disposed between the second stop and the rotatable component. When the expansion assembly is expanded, it forces the rotatable component against the first stop.

According to another aspect of the invention, a pump is featured that includes a shaft, a plurality of stops, a pump impeller disposed on the shaft between two of the plurality of stops, and an expansion assembly. The stops act as barriers to axial movement of one or more components, e.g., pump impeller, along the shaft. The expansion assembly is disposed along the shaft between the pump impeller and a first stop. The expansion assembly is expandable to force the pump impeller against a second stop.

According to another aspect of the invention, a submergible pumping system is featured that includes a source of rotational motive power and a submergible pump. The submergible pump includes a shaft that is drivingly coupled to the source of rotational motive power. The submergible pump also includes a plurality of stop rings, securable to the rotatable shaft, a rotatable component, and an expansion assembly. The expansion assembly is expandable to hold the rotatable component in place axially on the shaft between two of the plurality of stop rings.

According to another aspect of the invention, a method is provided for securing components to a rotatable shaft. The method includes placing a rotatable component at a desired location on a rotatable shaft. The method also includes securing a first stop to the rotatable shaft adjacent to the rotatable component. The method further includes placing an expansion assembly on the rotatable shaft adjacent to the other end of the rotatable component and securing a second stop to the rotatable shaft adjacent to the expansion assembly. Finally, the method includes expanding the expansion assembly to force the rotatable component against the first stop ring.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
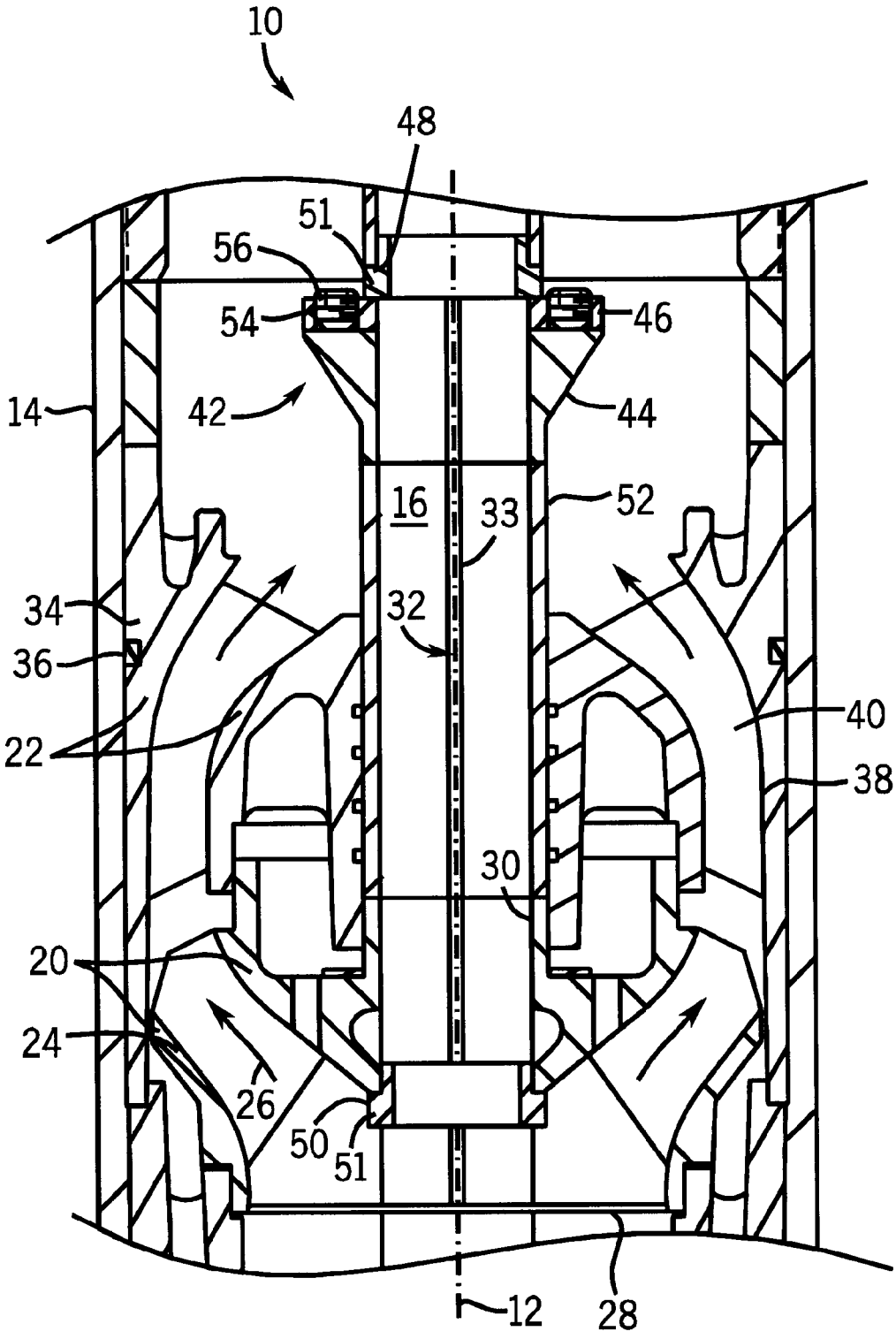
FIG. 1 is a front elevational view of a centrifugal pump, according to a preferred embodiment of the present invention.

Referring generally to FIG. 1, a portion of a centrifugal pump 10, according to a preferred embodiment of the present invention, is illustrated in cross-section taken generally along a central longitudinal axis 12. Centrifugal pump 10 includes an outer housing 14 that is generally tubular in construction. Within outer housing 14, a shaft 16 is rotatably mounted generally along longitudinal axis 12.

An exemplary centrifugal pump 10 is designed for use in a wellbore and typically include a series of sequential stages 18 disposed within outer housing 14 along longitudinal axis 12. However, the present invention is suitable for single stage pumps as well as multi-stage pumps. For the purpose of clarity in description, however, only one stage 18 is shown in the illustrated embodiment.

Each stage generally includes an impeller 20 and a diffuser 22. The components cooperate to pump a fluid, such as oil, from the impeller 20 through the diffuser 22, from one stage 18 to the next. The pumping action is provided by the impeller 20 as it rotates with shaft 16.

The diffusers 22 are mounted in a stationary position within outer housing 14 to guide the pumped fluid from one impeller 20 to the next. Specifically, each impeller 20 includes a plurality of vanes 24 that each define a fluid flow path 26 for directing fluid upwardly to the diffuser 22 as the impeller 20 rotates with shaft 16. Each impeller 20 further includes an inlet opening 28 through which the pumped fluid enters, and an impeller hub portion 30 that lies along the circumference of shaft 16.

Impeller 20 is radially fixed to the shaft 16 by a retention system, such as a drive key and keyway system 32. The drive key system 32 includes a longitudinal slot or keyway 33 formed in the shaft 16. A metal member, e.g., key, (not shown) is inserted into keyway 33, as is known to those of ordinary skill in the art. The metal member produces a raised ridge along the shaft for mating engagement with a corresponding keyway in a rotatable component, such as impeller 20.

The diffuser 22 is fixed in a stationary position within the outer housing 14. The diffuser 22 includes a seal ring groove 34 for receiving a seal 36 by which each diffuser forms a fluid seal with the interior surface of outer housing 14. The diffuser 22 includes a plurality of diffuser veins 38 each having a passageway 40. The fluid forced upwardly by a given impeller 20 is directed through passageways 40 to the next sequential impeller 20.

Each impeller 20 is fixed to shaft 16 axially by the operation of an expansion assembly 42. The expansion assembly 42 is comprised of an expansion sleeve 44 and an expansion member 46. In the illustrated embodiment, the expansion sleeve 44 and expansion member 46 surround the shaft 16. Additionally, an upper stop 48, such as a stop ring, is secured to the shaft 16 above expansion assembly 42 and a lower stop 50, such as a stop ring, is secured to the shaft 16 below the impeller hub portion 30. The stop rings each have a radially expanded portion 51 that forms a barrier to axial movement of the impeller 20. In an exemplary embodiment described below, the stop rings sit in grooves disposed around the shaft 16.

In the illustrated embodiment, a radial sleeve 52 surrounds the shaft between the impeller hub portion 30 and the expansion sleeve 44. (See also FIG. 2). The radial sleeve 52 acts as a spacer between the expansion assembly 42 and the impeller hub portion 30. The length of the radial sleeve 52 is dimensioned to correspond to the particular axial dimensions of the components of a given pump. This allows the use of expansion assemblies in a variety of pumps where the axial lengths of the impellers may vary. However, the radial sleeve 52 also can be formed as part of expansion sleeve 44.

Figure 2:
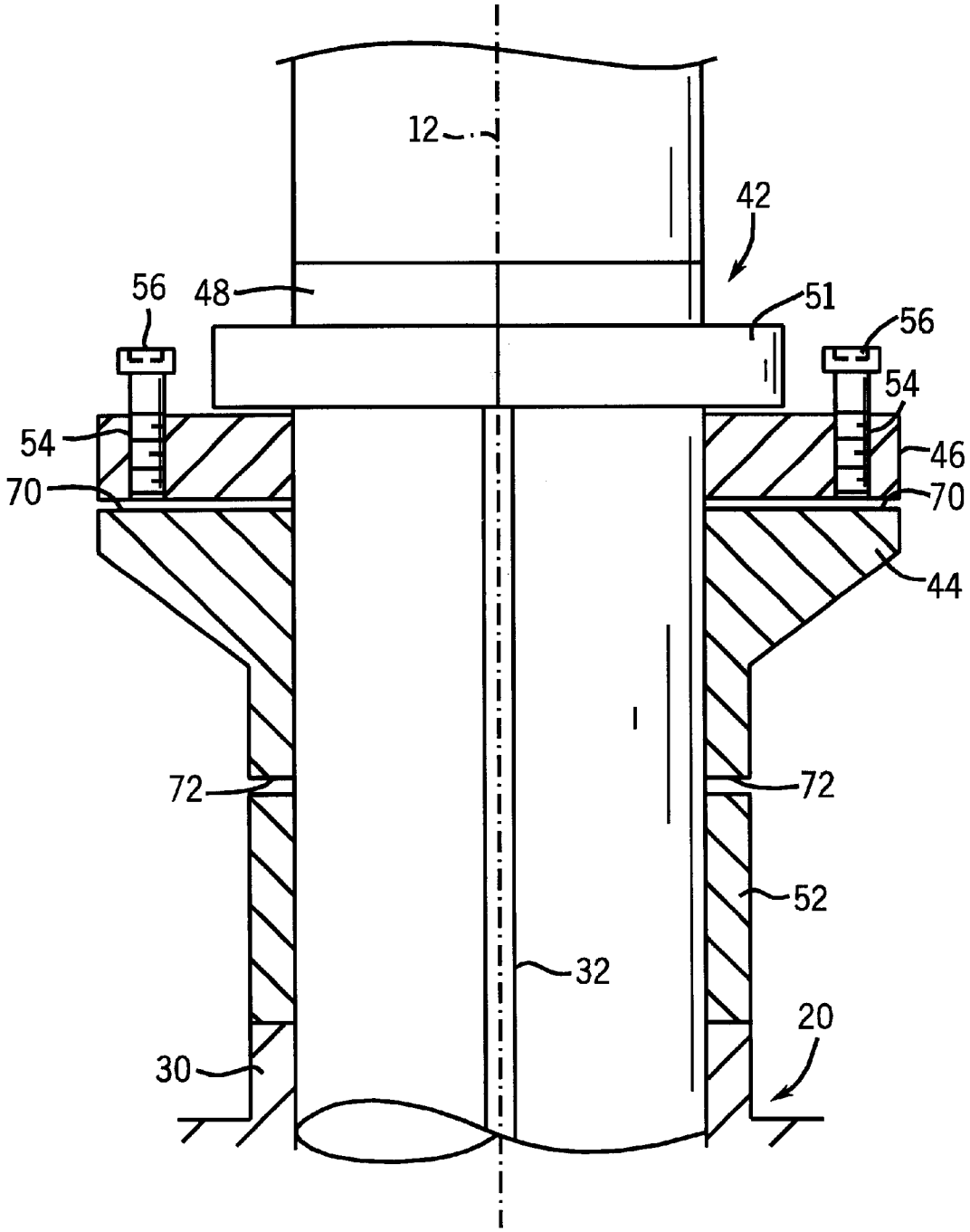
FIG. 2 is a cross-sectional view of an expansion assembly in an unexpanded position, according to a preferred embodiment of the present invention.

As illustrated in FIG. 2, expansion sleeve 44 surrounds shaft 16 adjacent radial sleeve 52 and expansion member 46. An exemplary expansion member 46 includes a plurality, e.g., two, threaded holes 54 oriented at a distance from one another, e.g., 180 degrees apart. Each threaded hole 54 has a corresponding screw 56 inserted therein. In FIG. 2, the screws 56 have not yet been threaded completely through the expansion member 46. Initially, the components are assembled so there is some freedom of movement along shaft 16 for the various rotatable components before expansion of the expansion assembly 42 and axial restriction of the components.

Figure 3:
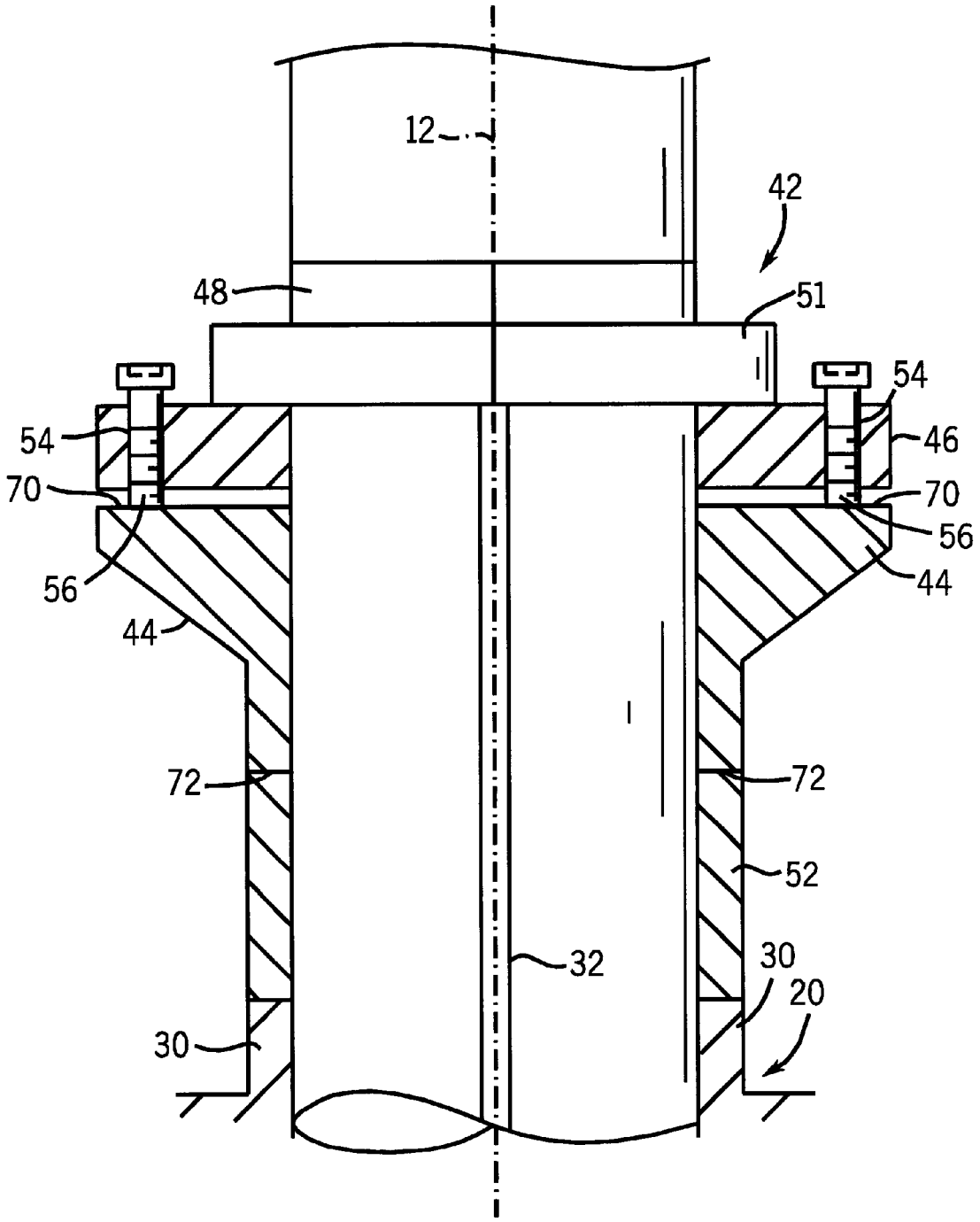
FIG. 3 is a cross-sectional view of an expansion assembly in an expanded position, according to a preferred embodiment of the present invention.

As illustrated in FIG. 3, axial movement of rotatable components, e.g., impeller 20, is then restricted by continued threading of screws 56 through threaded holes 54 of expansion member 46. Ultimately, expansion sleeve 44 is forced against sleeve 52, which, in turn, is forced against rotatable component 20. The expansion member is prevented from further axial movement by stop 48. Effectively, expansion assembly 42 is increased in overall axial length to remove any opportunity for axial movement by rotatable component 20.

Specifically, the axial length of the expansion assembly 42 increases during tightening of screws 56 until either the expansion member 46 contacts the upper stop ring 48 or the expansion sleeve 44 contacts the radial sleeve 52. The continued axial expansion of the expansion assembly 42 eventually forces the expansion member 46 against the upper stop ring 48, the expansion sleeve 44 against the radial sleeve 52, the radial sleeve 52 against the impeller hub portion 30, and the impeller hub portion 30 against the lower stop ring 52. This produces a compressive force on the impeller 20 that locks the impeller into position axially on the shaft.

Figure 4:
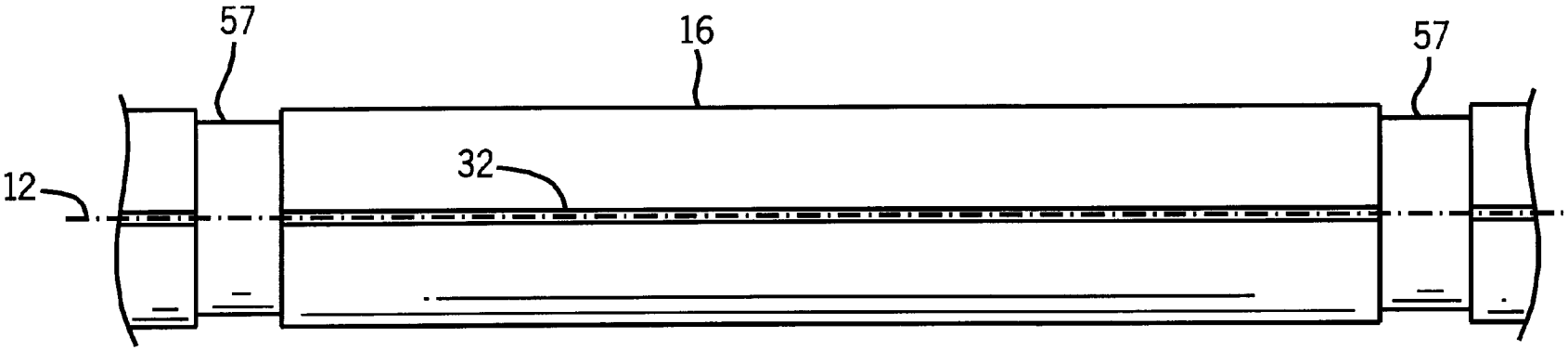
FIG. 4 is front view of a shaft, according to a preferred embodiment of the present invention.

Referring generally to FIG. 4, a portion of the shaft 16 is shown. An exemplary shaft 16 includes keyway 33 running parallel with the longitudinal axis 12. In the illustrated portion of the shaft 16, two stop ring grooves 57 are shown. The stop ring grooves 57 are spaced at a predetermined distance along the shaft so that rotatable components, such as the impeller 20, can fit between two stop rings. Several pump stages can be installed between a pair of stop rings. Alternatively, each pump stage can be installed between a pair of stop rings. Increasing the number of stop rings increases the number of stop ring grooves needed in the shaft 16.

Figure 5A:
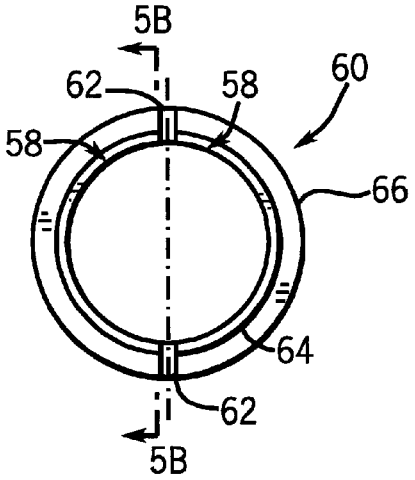
FIG. 5A is a top view of a single stop ring piece, according to a preferred embodiment of the present invention.
Figure 5B:
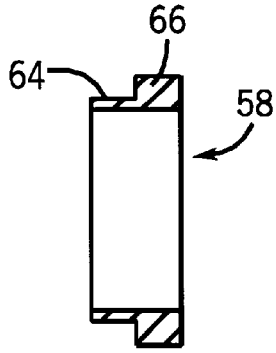
FIG. 5B is a cross-sectional view taken generally along line 5B—5B of FIG. 5A.

Referring also to FIGS. 5A and 5B, an exemplary stop ring is comprised of two stop ring portions 58. Each stop ring portion 58 is semicircular. In this embodiment, the two stop ring pieces 58 are formed as a single stop ring piece 60 having two weakened areas, such as milled slots 62. Once the machining process is completed, the single stop ring piece 60 is broken apart at the two milled slots 62 to form separate stop ring portions 58.

Each stop ring portion 58 has a radially inward surface 64 and a radial extension 66. Surface 64 lies flush with the outer surface of shaft 16 when stop ring portions 58 are seated in a stop ring groove 57. The radial extension 66 extends outwardly from the surface of shaft 16. Once the two stop ring portions 58 are in place and held together, radial extension 66 forms an abutment or stop that acts as a barrier to axial motion of rotatable components, including impellers 20 and expansion assemblies 42.

The two stop ring pieces 58 are held in a corresponding stop ring groove by the rotatable components mounted on the shaft 16. For example, in FIG. 1 the impeller hub portion 30 is shown surrounding and holding together the two stop ring portions of the lower stop ring 50. The lower stop ring 50, in turn, prevents impeller 20 from any further downward axial motion. Upper stop ring 48, on the other hand, held in place by the impeller of a subsequent stage of the pump or by some other rotatable component, such as an expansion assembly 42.

Figure 6A:
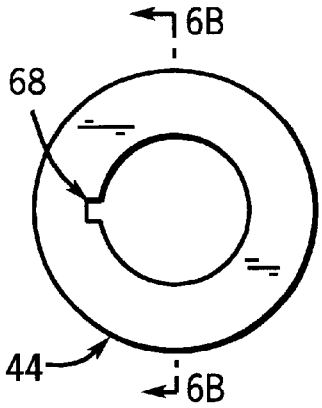
FIG. 6A is a top view of an expansion sleeve, according to a preferred embodiment of the present invention.
Figure 6B:
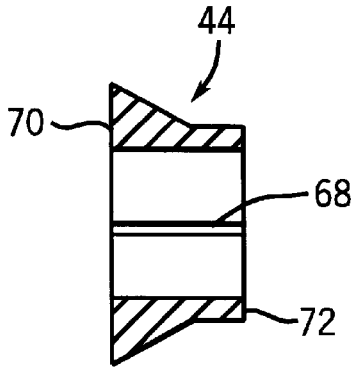
FIG. 6B is a cross-sectional view taken generally along line 6B—6B of FIG. 6A.

Referring also to FIGS. 6A and 6B, an exemplary expansion sleeve 44 is illustrated. Expansion sleeve 44 includes a keyway 68 that is aligned with keyway 33 of shaft 16 during assembly. A key (not shown) prevents rotation of sleeve 44 with respect to shaft 16. In this design, first end 70 of expansion sleeve 44 is disposed adjacent expansion member 46 and is flared to provide a contact surface for screws 56. The flared end of the expansion sleeve also serves to direct fluid toward the discharge of the pump. A second end 72 of expansion sleeve 44 abuts radial sleeve 52. However, the expansion sleeve need not be one piece. For example, the sleeve can be two semi-cylindrical pieces shaped to fit together around shaft 16.

Figure 7A:
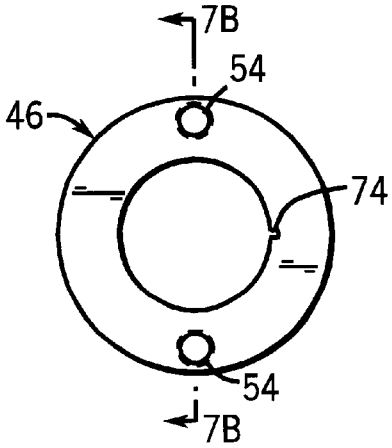
FIG. 7A is a top view of an expansion member, according to a preferred embodiment of the present invention.
Figure 7B:
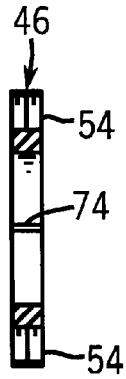
FIG. 7B is a cross-sectional view of an expansion member taken generally along its axis, according to a preferred embodiment of the present invention.

Referring also to FIGS. 7A and 7B, an exemplary expansion member 46 is illustrated. Expansion member 46 also utilizes a keyway 74 to maintain its rotational position on shaft 16. In this embodiment, expansion member 46 is a circular disc having two threaded holes 54 oriented 180 degrees apart. However, the number and orientation of the threaded holes 54 and their respective screws can vary. Furthermore, the expansion member 46 need not be circular nor a single piece.

Figure 8:
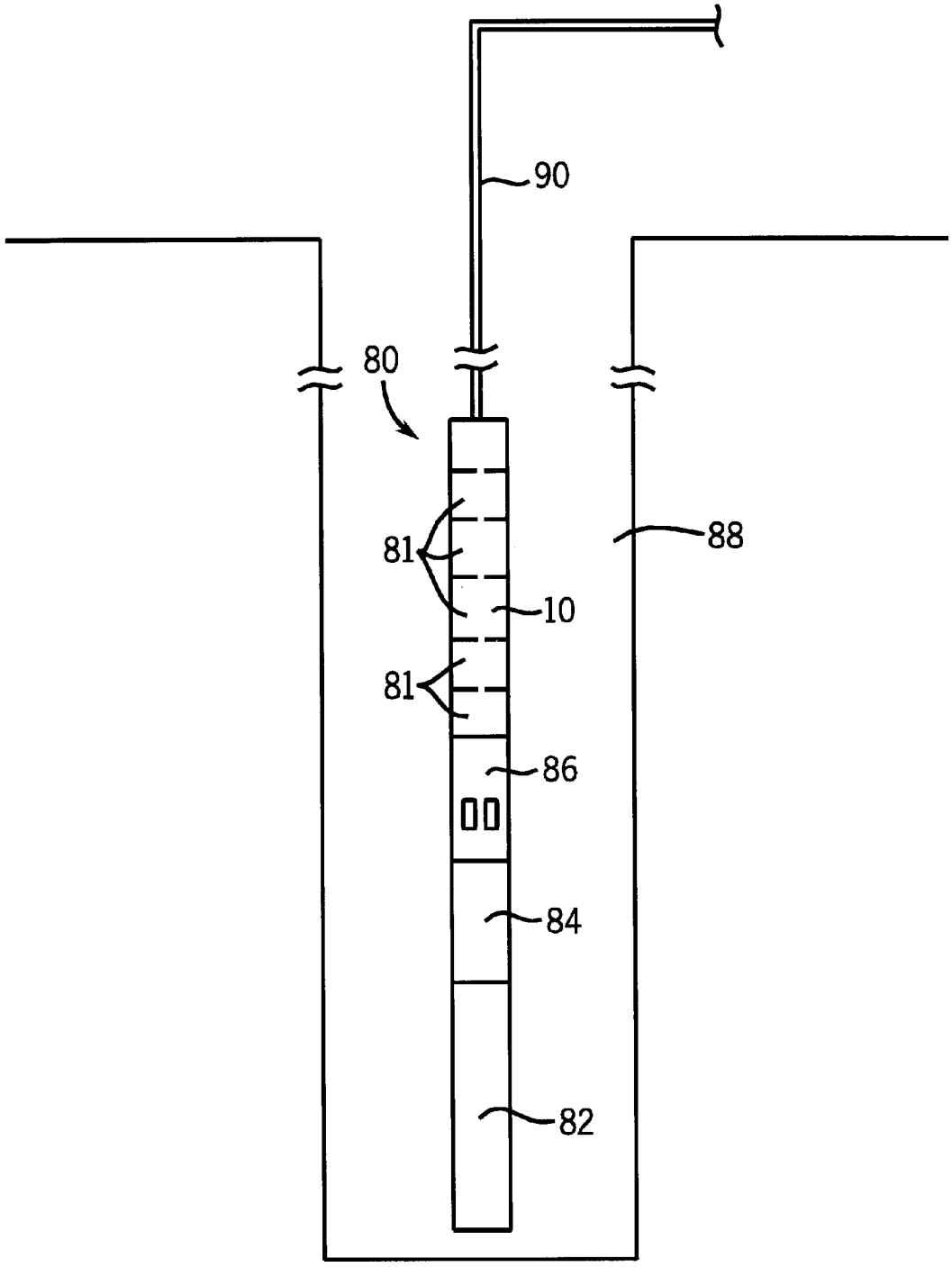
FIG. 8 is an elevational view of a submergible pumping system, according to a preferred embodiment of the present invention.

Referring generally to FIG. 8, a submergible pumping system 80 is shown utilizing submergible pump 10. The submergible pump 10 is a centrifugal pump comprised of a shaft and multiple pumping stages 81. The submergible pump 10 utilizes the system of the present invention to mount the impellers to the shaft. The shaft of the submergible pump 10 is drivingly coupled to a submergible electric motor 82 through a motor protector 84 and a fluid intake 86. During operation, the submergible pumping system 80 is placed within a wellbore 88. Wellbore fluids that collect in wellbore 88 are drawn into the submergible pumping system 80 through fluid intake 86. The submergible pump 10 pumps the wellbore fluids from the wellbore 88 to the surface through, for example, production tubing 90.

It will be understood that the foregoing description is of preferred exemplary embodiments of this invention and that the invention is not limited to the specific forms shown. For example, the present invention is not limited to securing impellers to the shafts of centrifugal pumps. The system of the present invention can be used to secure other types of rotatable components to a rotatable shaft. These and other modifications may be made in the design and arrangement of the elements without departing from the scope of the invention as expressed in the appended claims.

What is claimed is:

1. A pump, comprising:

a shaft;

a first stop acting as a barrier to axial movement along the shaft;

a second stop acting as a barrier to axial movement along the shaft;

a pump impeller disposed on the shaft between the first stop and the second stop; and an expansion assembly having at least one adjuster, the expansion assembly being disposed along the shaft between the pump impeller and at least one of the first and the second stops, wherein the expansion assembly is axially expandable upon movement of the at least one adjuster to restrict axial movement of the pump impeller.

2. A submergible pumping system, comprising;

a source of rotational motive power; and a submergible pump, including:

a shaft, drivingly coupled to the source of rotational motive power;

a pump impeller;

a plurality of stops, disposed on the shaft and forming a barrier to axial movement along the shaft; and an expansion assembly, wherein the expansion assembly is expandable to rigidly hold the pump impeller in axial position on the shaft between two of the plurality of stops.

3. The system as recited in claim 2, wherein a pump comprises a plurality of pump impellers, each pump impeller being held in axial position on the shaft by a respective set of stop rings and a corresponding expansion assembly.

4. A system for securing a rotatable component to a rotatable shaft, comprising:

a pump having:

a rotatable shaft;

a rotatable component, disposed on the rotatable shaft;

a first stop forming a barrier to axial motion along the rotatable shaft;

a second stop, forming a barrier to axial motion along the rotatable shaft; and an expansion assembly having an expansion sleeve, an expansion member and an adjuster acting between the expansion sleeve and the expansion member, wherein the axial length of the expansion assembly is adjustable to eliminate axial movement of the rotatable component between the first stop and the second stop via selective movement of the adjuster.

5. The system as recited in claim 4, wherein increasing the axial length of the expansion assembly forces the rotatable component against the first stop.

6. The system as recited in claims 5, wherein the expansion assembly comprises an expansion sleeve and an expansion member.

7. The system as recited in claim 6, wherein the expansion assembly is operable to produce a relative displacement between the expansion member and the expansion sleeve.

8. The system as recited in claim 7, wherein the second stop limits the axial motion of the expansion member.

9. The system as recited in claim 7, wherein increasing the relative displacement between the expansion member and the expansion sleeve produces an axial movement of the expansion sleeve towards the rotatable component.

10. The system as recited in claim 7, wherein the rotatable component abuts the expansion sleeve and increasing the relative displacement between the expansion member and the expansion sleeve produces a force on the rotatable component.

11. The system as recited in claim 10, wherein the axial force from the expansion assembly forces the rotatable component against the first stop.

12. The system as recited in claim 6, wherein the expansion member includes a threaded hole therethrough to threadably receive the adjuster.

13. A system for securing a rotatable component to a rotatable shaft, comprising:

a pump having:

a rotatable shaft;

a rotatable component, disposed on the rotatable shaft;

a first stop forming a barrier to axial motion along the rotatable shaft;

a second stop, forming a barrier to axial motion along the rotatable shaft; and an expansion assembly, the axial length of the expansion assembly being adjustable to eliminate axial movement of the rotatable component between the first stop and the second stop, wherein increasing the axial length of the expansion assembly forces the rotatable component against the first stop, the expansion assembly further comprising an expansion sleeve, a screw and an expansion member having a threaded hole therethrough for receiving the screw, wherein threading the screw through the expansion member into contact with the expansion sleeve produces relative displacement between the expansion member and the expansion sleeve.

14. The system as recited in claim 6, further comprising of a radial sleeve disposed between the expansion sleeve and the rotatable component.

15. The system as recited in claim 4, wherein the shaft includes a plurality of annular grooves.

16. The system as recited in claim 15, wherein each stop is formed of a plurality of stop ring portions, each having a radial extension and a radially inward surface disposed generally flush with an outer surface of the shaft when the plurality of stop ring portions are received in one of the annular grooves, such that when the plurality of stop ring pieces are seated in a radial groove the raised portion forms a barrier to axial movement along the shaft.

17. The system of claim 4, wherein the rotatable component comprises an impeller.

* * * * *